US011433414B2

(12) United States Patent
Fan et al.

(10) Patent No.: US 11,433,414 B2
(45) Date of Patent: Sep. 6, 2022

(54) SELF-CLEANING WATER OUTLET DEVICE AND A SWINGING WATER OUTLET DEVICE

(71) Applicant: Xiamen Solex High-Tech Industries Co., Ltd., Xiamen (CN)

(72) Inventors: Qihua Fan, Xiamen (CN); Donghai Chen, Xiamen (CN); Mingfu Zhang, Xiamen (CN); Wenxing Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 256 days.

(21) Appl. No.: 16/673,918

(22) Filed: Nov. 4, 2019

(65) Prior Publication Data

US 2020/0061658 A1 Feb. 27, 2020

Related U.S. Application Data

(63) Continuation of application No. PCT/CN2018/085302, filed on May 2, 2018.

(30) Foreign Application Priority Data

May 3, 2017 (CN) ..... 201710303792.3
May 3, 2017 (CN) ..... 201720480295.6

(51) Int. Cl.
*B05B 15/522* (2018.01)
*B05B 1/08* (2006.01)
*B05B 1/18* (2006.01)

(52) U.S. Cl.
CPC ..... *B05B 15/5225* (2018.02); *B05B 1/083* (2013.01); *B05B 1/18* (2013.01)

(58) Field of Classification Search
CPC ..... B05B 1/18; B05B 1/185; B05B 15/522; B05B 15/5223; B05B 15/5225
See application file for complete search history.

(56) References Cited

U.S. PATENT DOCUMENTS 2,251,192 A * 7/1941 Krumsiek ..... B05B 1/3046 239/117
6,739,527 B1 5/2004 Chung
(Continued)

FOREIGN PATENT DOCUMENTS

CN 203935930 U 11/2014
CN 104307673 A 1/2015
(Continued)

OTHER PUBLICATIONS

International Search Report and Written Opinion with English Translation of ISR, cited in PCT/CN2018/085302 dated Aug. 8, 2018, 12 pages.

*Primary Examiner* — Tuongminh N Pham
(74) *Attorney, Agent, or Firm* — Cooper Legal Group, LLC

(57) ABSTRACT

The present disclosure discloses a self-cleaning water outlet device, which comprises: a body, a deposit removal needle plate disposed in the body, a water outlet cover comprising a plurality of water outlet holes, and a rotatable member driven about an axial direction of the rotatable member by flowing water. An axial direction of the deposit removal needle plate and an axial direction of the water outlet cover are coaxial, and the deposit removal needle plate has a plurality of needles. The deposit removal needle plate is swingably connected with the rotatable member. When water flows into the water outlet device, the water flow drives the rotatable member to rotate, and the rotatable member drives each of the plurality of needles to swing
(Continued)

about the axial direction of the deposit removal needle plate in a corresponding one of the plurality of water outlet holes.

22 Claims, 9 Drawing Sheets

(56) References Cited

U.S. PATENT DOCUMENTS

| | | | | |
|---|---|---|---|---|
| 7,770,820 | B2 * | 8/2010 | Clearman | B05B 3/16 239/222.11 |
| 8,794,543 | B2 * | 8/2014 | Leber | B05B 3/04 239/381 |
| 9,457,362 | B2 * | 10/2016 | Chan | B05B 15/5225 |
| 9,839,923 | B2 * | 12/2017 | Ramos De Barros | B05B 1/3006 |

FOREIGN PATENT DOCUMENTS

| | | | |
|---|---|---|---|
| CN | 106076678 | A | 11/2016 |
| CN | 205701133 | U | 11/2016 |
| CN | 205833405 | U | 12/2016 |
| CN | 207119498 | U | 3/2018 |
| EP | 2767347 | A1 | 8/2014 |

* cited by examiner

SELF-CLEANING WATER OUTLET DEVICE AND A SWINGING WATER OUTLET DEVICE

RELATED APPLICATIONS

This applications is a continuation of and claims priority to PCT Patent Application PCT/CN2018/085302, filed on May 2, 2018, which claims priority to Chinese Patent Application 201710303792.3 and Chinese Patent Application 201720480295.6, both filed on May 3, 2017. PCT Patent Application PCT/CN2018/085302, Chinese Patent Application 201710303792.3, and Chinese Patent Application 201720480295.6 are incorporated herein by reference.

FIELD OF THE DISCLOSURE

The present disclosure relates to a water outlet device.

BACKGROUND OF THE DISCLOSURE

The shower head is a kind of shower device that is commonly used in daily life. When the shower head is used for a long time or in a place with poor water quality, sediment or scale attached to an inner wall of a water outlet hole on a water outlet surface of the shower head. Overtime, the scale or sediment will accumulate and block the water outlet hole, causing the shower head to not work properly. For this reason, there are many shower heads with a descaling function on the market. Generally, a descaling plate with a plurality of descaling needles disposed on a bottom surface of the descaling plate is movably arranged in the shower head, and descaling is driven manually or by flowing water. In the existing descaling products, the descaling plate moves in the axial direction. In order to ensure smooth movement of the descaling plate, a gap of a certain size must be left between the descaling needles and the inner wall of the water outlet hole, otherwise the descaling plate will not move normally because of friction between the descaling needles and the inner wall of the water outlet hole. However, if there is a gap between the descaling needles and the inner wall of the water outlet hole, scale or sediment attached to the inner wall of the water outlet hole cannot be completely removed, which causes the exiting water to be redirected and the purpose of cleaning the scale or sediment cannot be achieved.

BRIEF SUMMARY OF THE DISCLOSURE

The present disclosure provides a self-cleaning water outlet device to solve deficiencies of the existing techniques. During the water discharge process, the needles swing about an axial direction in water outlet holes of a water outlet cover, so that the scale or sediment attached to the inner walls of the water outlet holes is automatically removed.

In order to solve the aforementioned technical problems, the present disclosure provides a self-cleaning water outlet device, which comprises a body, a deposit removal needle plate disposed in the body, a water outlet cover comprising a plurality of water outlet holes, and a rotatable member driven to rotate about an axial direction of the rotatable member by flowing water. An axial direction of the deposit removal needle plate and an axial direction of the water outlet cover are coaxial. The deposit removal needle plate comprises a plurality of needles, and the deposit removal needle plate is swingably connected to the rotatable member. When water flows into the self-cleaning water outlet device, the water drives the rotatable member to rotate, the rotatable member drives each of the plurality of needles to swing about the axial direction of the deposit removal needle plate in a corresponding one of the plurality of water outlet holes, and each of the plurality of needles rubs against sediment deposited on an inner wall of the corresponding one of the plurality of water outlet holes while each of the plurality of needles are swinging to dislodge the sediment.

In a preferred embodiment, the body comprises an oblique water body, and the oblique water body comprises a chamber. In an axial direction of the chamber, a first end of the chamber is disposed with a water inlet, and a sidewall of the chamber is disposed with a plurality of oblique water outlets arranged along a circumferential direction of the chamber.

In a preferred embodiment, the rotatable member is an impeller disposed outside of the sidewall of the chamber, and the water flows into the impeller from the plurality of oblique water outlets. Blades of the impeller are impacted to drive the impeller to rotate by the water.

In a preferred embodiment, a first side of the impeller facing the deposit removal needle plate extends downward in the axial direction of the rotatable member to form a cam. A first side of the deposit removal needle plate facing the oblique water body extends upward in the axial direction of deposit removal needle plate to form a connecting member. The cam is disposed in the connecting member, and a sidewall of the cam abuts a sidewall of the connecting member to define a swing connection.

In a preferred embodiment, the impeller is disposed with a water outlet at, in the axial direction of the rotatable member, a lower end of the impeller. The water flows out from the plurality of oblique water outlets, enters into the impeller, flows out from the water outlet, and then flows to the deposit removal needle plate. The at least one flow hole is disposed in the axial direction of the deposit removal needle plate, and the water flows from the at least one flow hole into the plurality of water outlet holes.

In a preferred embodiment, the self-cleaning water outlet device further comprises a movable member. The movable member is driven by the water and moves in an axial direction of the body. The deposit removal needle plate and the moving member are connected in the axial direction of the body. When the water flows into the self-cleaning water outlet device, the water flows to drive the movable member to drive the deposit removal needle plate to move downward in the axial direction of the body, and each of the plurality of needles move into the corresponding one of the plurality of water outlet holes.

In a preferred embodiment, in the axial direction of the chamber, a second end of the chamber away from the water inlet is disposed with a through hole. A first end of the movable member passes through the through hole and abuts the deposit removal needle plate and is linked to the deposit removal needle plate, and a second end of the movable member is disposed in the chamber. When the water flows from the water inlet into the chamber, an impact force generated by the water flowing on the movable member drives the movable member to move downward in the axial direction of the chamber.

In a preferred embodiment, in an axial direction of the cam, the cam is disposed with a locating hole. The movable member is inserted into the connecting member through the locating hole and abuts, in the axial direction of the cam, a bottom end surface of the connecting member.

In a preferred embodiment, a reset member is disposed between the deposit removal needle plate and the water outlet cover. When the deposit removal needle plate moves downward in the axial direction of the deposit removal needle plate, the reset member accumulates an elastic reset force.

In a preferred embodiment, the second end of the movable member is a water storage end. When no water flows into the chamber from the water inlet, the reset member drives the deposit removal needle plate to move upward in the axial direction of the deposit removal needle plate, and the water storage end moves upward, in an axial direction of the movable member, toward the water inlet.

The present disclosure further provides a swinging water outlet device, which comprises a body, a flowing water switchable member disposed in the body, a water outlet cover comprising a plurality of water outlet holes, and a rotatable member driven to rotate about an axial direction of the rotatable member by flowing water. An axial direction of the flowing water switchable member and an axial direction of the water outlet cover are coaxial. The flowing water switchable member comprises a plurality of switchable units, and the flowing water switchable member is swingably connected to the rotatable member. When water flows into the swinging water outlet device, the water drives the rotatable member to rotate, the rotatable member drives each of the plurality of switchable units to swing about the axial direction of the flowing water switchable member in a corresponding one of the plurality of water outlet holes, and a flow direction of the water in each of the plurality of water outlet holes changes due to a swing movement of a corresponding one of the plurality of switchable units.

In a preferred embodiment, the body comprises an oblique water body, and the oblique water body comprises a chamber. In an axial direction of the chamber, a first end of the chamber is disposed with a water inlet, and a sidewall of the chamber is disposed with a plurality of oblique water outlets arranged along a circumferential direction of the chamber.

In a preferred embodiment, the rotatable member is an impeller disposed outside of the sidewall of the chamber, and the water flows into the impeller from the plurality of oblique water outlets. Blades of the impeller are impacted to drive the impeller to rotate by the water.

In a preferred embodiment, a first side of the impeller facing the flowing water switchable member extends downward in the axial direction of the rotatable member to form a cam. A first side of the flowing water switchable member facing the oblique water body extends upward in the axial direction of flowing water switchable member to form a connecting member. The cam is disposed in the connecting member, and a sidewall of the cam abuts a sidewall of the connecting member to define a swing connection.

In a preferred embodiment, the impeller is disposed with a water outlet at, in the axial direction of the rotatable member, a lower end of the impeller. The water flows out from the plurality of oblique water outlets, enters into the impeller, flows out from the water outlet, and flows to the flowing water switchable member. The flowing water switchable member is disposed with at least one flow hole disposed in the axial direction of the flowing water switchable member, and the water flows from the at least one flow hole into the plurality of water outlet holes.

In a preferred embodiment, the swinging water outlet device further comprises a movable member, and the movable member is driven by the water and moves in an axial direction of the body. The flowing water switchable member and the moving member are connected in the axial direction of the body. When the water flows into the swinging water outlet device, the water flows to drive the movable member to drive the flowing water switchable member to move downward in the axial direction of the body, and each of the plurality of switchable units move into the corresponding one of the plurality of water outlet holes.

In a preferred embodiment, in the axial direction of the chamber, a second end of the chamber away from the water inlet is disposed with a through hole. A first end of the movable member passes through the through hole and abuts the flowing water switchable member and is linked to the flowing water switchable member, and a second end of the movable member is disposed in the chamber. When the water flows from the water inlet into the chamber, an impact force generated by the water flowing on the movable member drives the movable member to move downward in the axial direction of the chamber.

In a preferred embodiment, in an axial direction of the cam, the cam is disposed with a locating hole, the movable member is inserted into the connecting member through the locating hole and abuts, in the axial direction of the cam, a bottom end surface of the connecting member.

In a preferred embodiment, a reset member is disposed between the flowing water switchable member and the water outlet cover. When the flowing water switchable member moves downward in the axial direction of the flowing water switchable member, the reset member accumulates an elastic reset force.

In a preferred embodiment, the second end of the movable member is a water storage end. When no water flows into the chamber from the water inlet, the reset member drives the flowing water switchable member to move upward in the axial direction of the flowing water switchable member, and the water storage end moves upward, in an axial direction of the movable member, toward the water inlet.

Compared with existing techniques, the technical solution provided by the present disclosure has the following advantages:

1. The self-cleaning water outlet device provided by the present disclosure drives the descaling needle plate to swing by the rotation of the impeller, thereby causing the needle to swing about the axial direction in the water outlet hole of the water outlet cover. The needle abuts the inner wall of the water outlet hole during the swinging process, so that the scale attached to the inner wall of the water outlet hole falls off as the needle swings. Compared with the conventional manner in which the needle moves in the axial direction, the method of the present disclosure can make the scale attached to the inner wall of the water outlet hole fall more completely, so that the water is not easily redirected and the descaling effect is good.

2. The present disclosure provides a self-cleaning water outlet device in which the descaling needle plate moves upward in the axial direction when the water is shut off and moves downward in the axial direction when the water is flowing. Therefore, the needle is not inserted when the water is turned off. There will be no residual water in the outlet hole. This eliminates the possibility of residual water breeding bacteria between the water outlet and the needle.

3. The present disclosure provides a self-cleaning water outlet device provided by the present disclosure in which the descaling is continued throughout the water outflowing process. In the conventional manner, the descaling is completed at the instant the water is turned on or off, and the descaling time is short. Therefore, the descaling time of the solution of the present disclosure is longer, and the descaling effect is of course better.

4. The present disclosure provides a self-cleaning water outlet device in which one end of the moving member closes the water inlet in the water shut-off state. Therefore, when the water is flowing, the water storage end has a certain water storage function, and only when the water pressure reaches a certain value does the moving member move downward in the axial direction to completely open the water inlet. This allows the flow rate of the water entering the chamber to be relatively fast, and the initial rotational speed of the impeller to be relatively fast. Therefore, the swinging speed of the needle is also increased, and the friction between the needle and the inner wall of the water outlet hole is increased. Therefore, the descaling strength is increased.

5. The present disclosure provides a swinging water outlet device in which, when water is flowing, the rotatable member drives the switchable units to swing about the axial direction in the water outlet hole of the water outlet cover. The switchable units abut the inner wall of a corresponding water outlet hole during the swinging process to close a portion of the water outlet hole, so that the direction of the water flow in the water outlet hole changes with the swinging of the switchable units. The swinging water outlet device can form a large particle water spray pattern in which the water droplets are cone-shaped, the water flow distribution is more uniform, the coverage is large, a pulse effect is achieved, and the shower experience is excellent.

DETAILED DESCRIPTION OF THE EMBODIMENTS

The present disclosure will be further described below with the combination of the accompanying drawings together with the embodiments.

Embodiment 1

Figure 1:
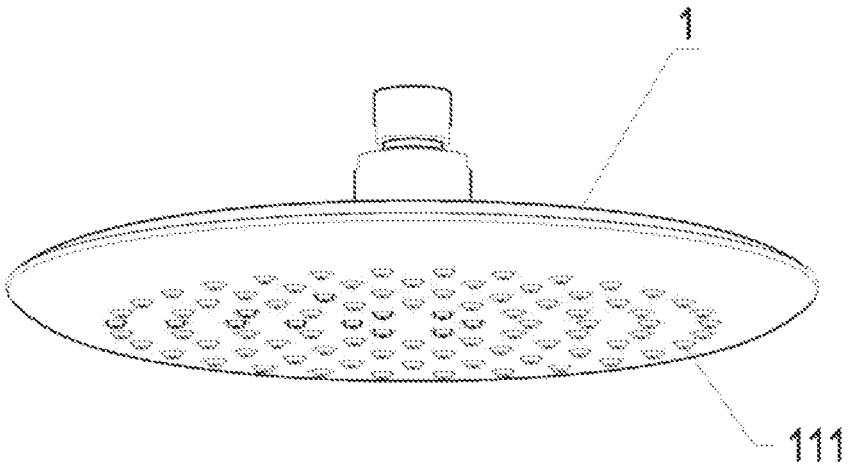
FIG. 1 illustrates a schematic view of a shower head in a no water flowing state in a preferred embodiment of the present disclosure.
Figure 2:
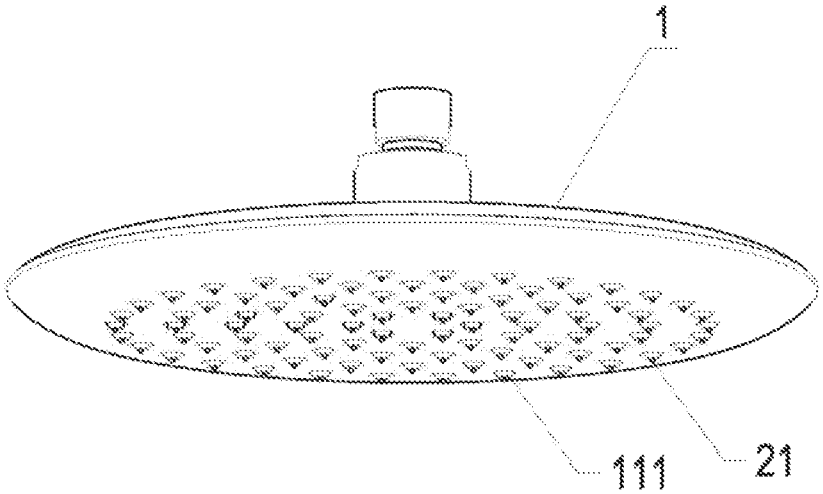
FIG. 2 illustrates a schematic view of the shower head in a water flowing state in the preferred embodiment of the present disclosure.
Figure 3:
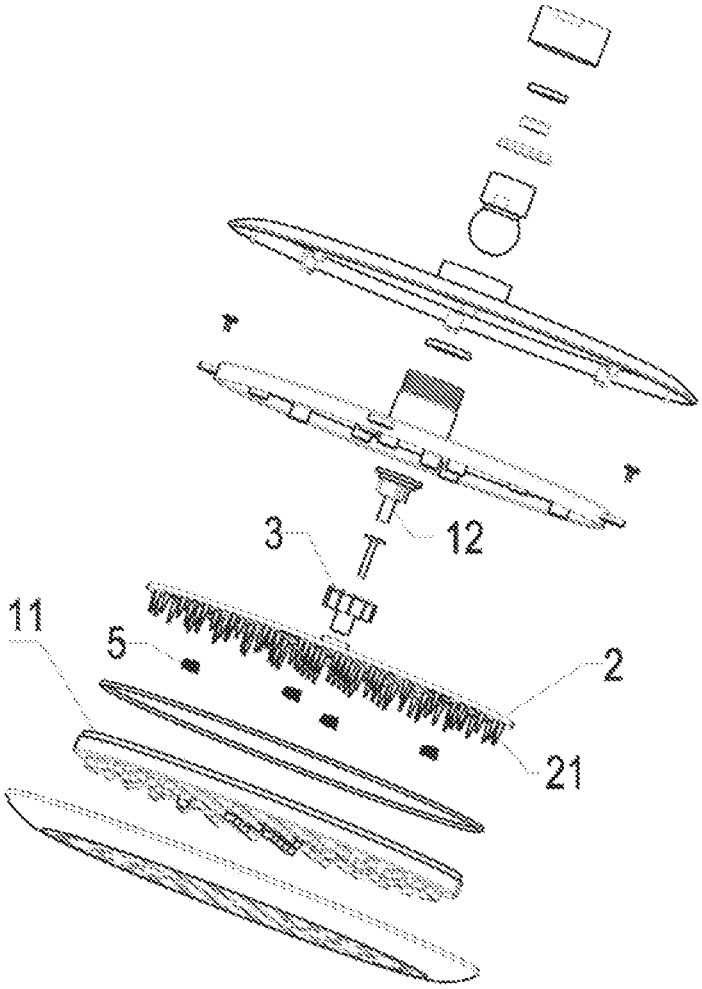
FIG. 3 illustrates an exploded perspective view of the shower head in the preferred embodiment of the present disclosure.
Figure 4:
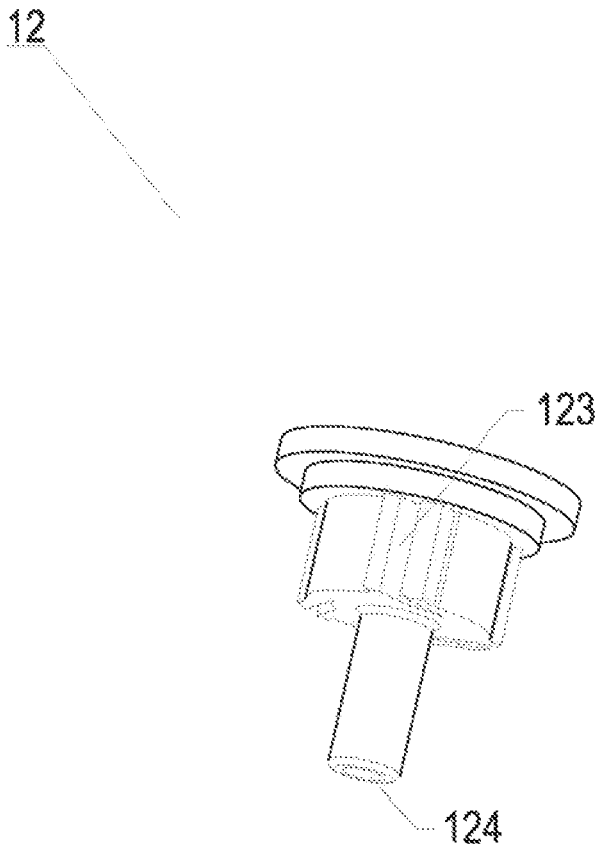
FIG. 4 illustrates a schematic view of an oblique water body in the preferred embodiment of the present disclosure.
Figure 5:
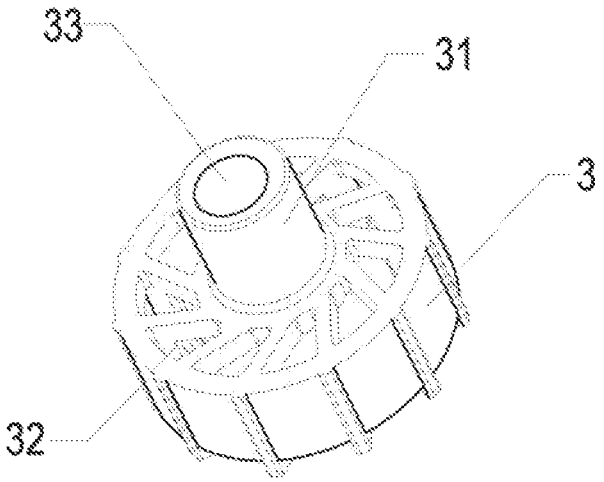
FIG. 5 illustrates a schematic view of an impeller in the preferred embodiment of the present disclosure.
Figure 6:
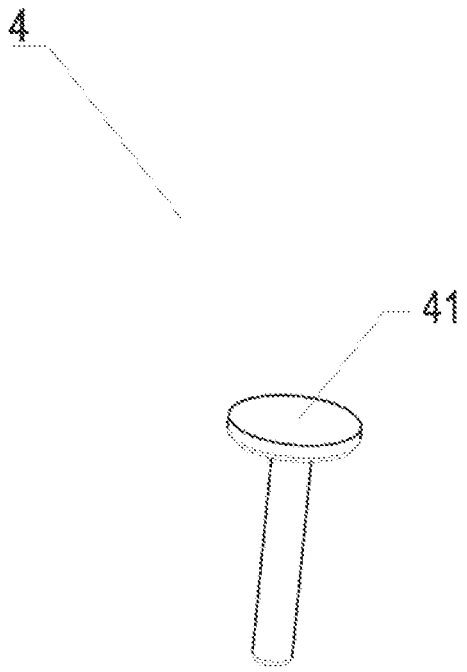
FIG. 6 illustrates a schematic view of a moving member in the preferred embodiment of the present disclosure.
Figure 7:
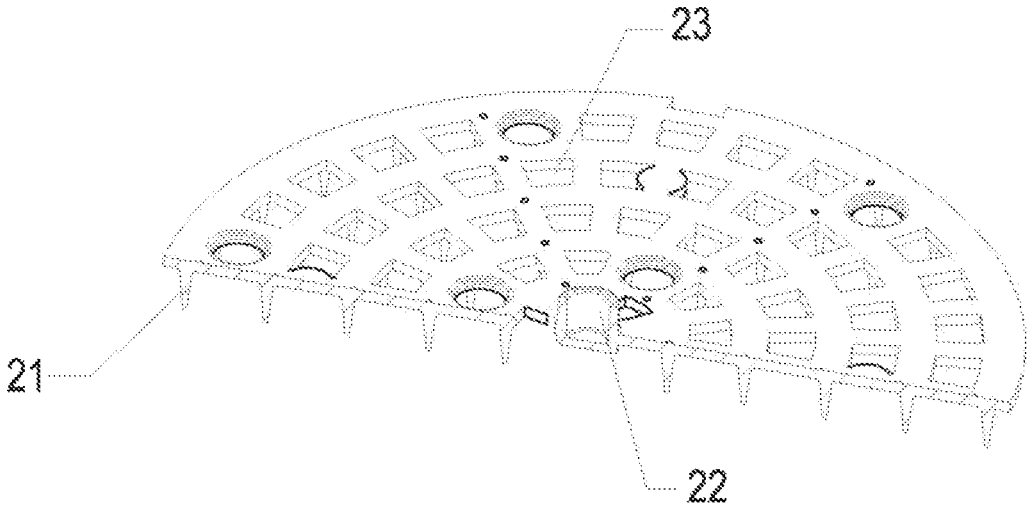
FIG. 7 illustrates a schematic view of a descaling needle plate in the preferred embodiment of the present disclosure.
Figure 8:
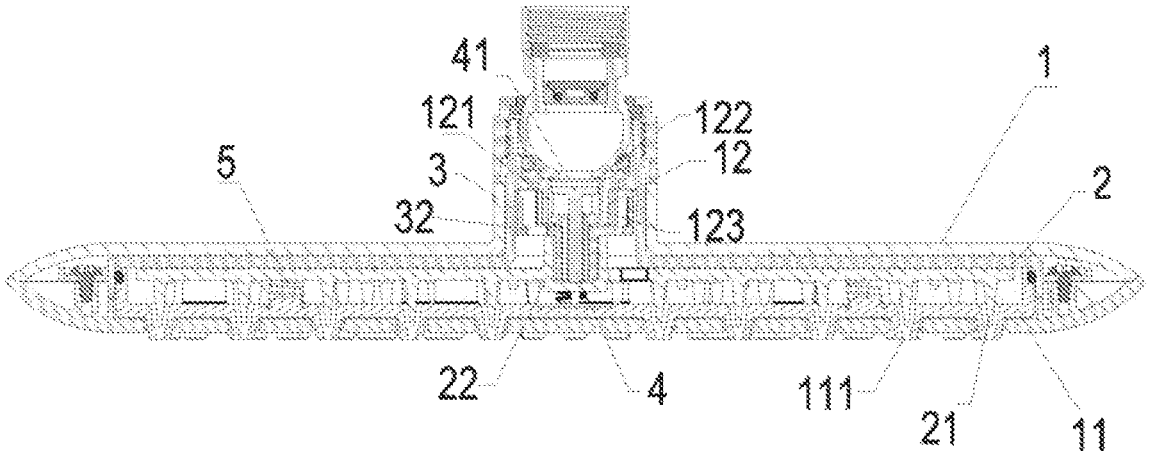
FIG. 8 illustrates a sectional view of the shower head in a no water flowing state in the preferred embodiment of the present disclosure.
Figure 9:
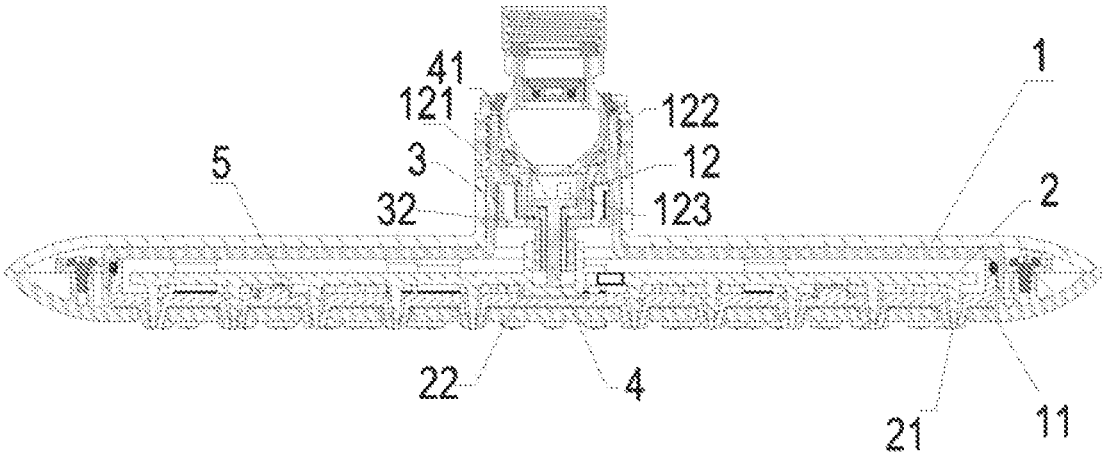
FIG. 9 illustrates a sectional view of the shower head in a water flowing state in the preferred embodiment of the present disclosure.

Referring to FIGS. 1-9, a self-cleaning water outlet device in this embodiment is preferably but not limited to a shower head. The shower head comprises a body 1, a deposit removal needle plate 2 disposed in the body 1, and a rotatable member 3 driven to rotate about an axial direction of the rotatable member 3 by flowing water.

An axial direction of the deposit removal needle plate 2 and an axial direction of a water outlet cover 11 are coaxial. The deposit removal needle plate 2 comprises a plurality of needles 21, and the deposit removal needle plate 2 is swingably connected to the rotatable member 3. Each of the plurality of needles 21 defines a solid structure.

When water flows into the self-cleaning water outlet device, the water drives the rotatable member 3 to rotate, and the rotatable member 3 drives each of the plurality of needles 21 to swing about the axial direction of the deposit removal needle plate 2 in a corresponding one of a plurality of water outlet holes 111 of the water outlet cover 11. Each of the plurality of needles 21 rubs against sediment deposited on an inner wall of a corresponding one of the plurality of water outlet holes 111 during a swinging process. Therefore, the sediment deposited on the inner wall of each of the plurality of water outlet holes 111 falls off when a corresponding one of the plurality of needles swings. Compared with the traditional needle moving in an axial direction thereof, when using the deposit removal method disclosed in this embodiment, the sediment deposited to the inner wall of each of the plurality of water outlet hole falls off more thoroughly, and the deposit removal effect is good. Therefore, the disadvantages in the conventional deposit removal method (i.e., that the sediment between the plurality of needles and the inner walls of the plurality of water outlet holes cannot be removed) are solved.

In this embodiment, the body 1 is disposed with an oblique water body 12, and the oblique water body 12 comprises a chamber 121. In an axial direction of the chamber 121, a first end of the chamber 121 is disposed with a water inlet 122. A sidewall of the chamber 121 is disposed with a plurality of oblique water outlets 123 arranged along a circumferential direction of the chamber 121, so that the water flowing along the axial direction of the chamber 121 is converted into the oblique water flowing along an inclined direction by the oblique water body 12.

The rotatable member 3 is an impeller disposed outside of the sidewall of the chamber 121 of the oblique water body 12. The water flows into the impeller from the plurality of oblique water outlets 123, and blades of the impeller are impacted to drive the impeller to rotate by the water.

In order to cause the impeller driving the deposit removal needle plate 2 to swing, a first side of the impeller facing the deposit removal needle plate 2 extends downward in the axial direction of the rotatable member 3 to form a cam 31. A first side of the deposit removal needle plate 2 facing the oblique water body 12 extends upward in an axial direction of deposit removal needle plate 2 to form a connecting member 22. The cam 31 is inserted into the connecting member 22, and a sidewall of the cam 31 abuts a side of a sidewall of the connecting member 22, so that when the impeller rotates, the cam 31 rotates in the connecting member 22 and an abutting force between the sidewall of the cam 31 and the connecting member 22 drives the deposit removal needle plate 2 to swing.

At the same time, in order to obtain a normal water outflow of the shower head, the water flowing into the impeller also needs to flow out from the plurality of water outlet holes 111 of the water outlet cover 11. Therefore, in the axial direction of the rotatable member 3, the impeller comprises with at least one water outlet 32 at a lower end. The water flows out from the oblique water outlet 123 to enter into the impeller, and then flows out from the at least one water outlet 32 to the deposit removal needle plate 2. In the axial direction of the deposit removal needle plate 2, the deposit removal needle plate 2 comprises a plurality of flow holes 23, and the water flows from the plurality of flow holes 23 into the plurality of water outlet holes 111 of the water outlet cover 11, thus forming the normal shower water. The plurality of flow holes 23 are offset from the plurality of needles 21. The water flows through the plurality of flow holes 23 and a clearance between the plurality of needles 21 and inner walls of the plurality of water outlet holes 111. A lower side of the deposit removal needle plate 2 are filled with the water flowing from the plurality of flow holes 23.

At this point, a first purpose of the normal water outflow of the shower head and a second purpose of removing deposits while the water is flowing have been achieved. However, the aforementioned technical solution requires that each of the plurality of needles 21 be always located in each of the plurality of water outlet holes 111. After the water is shut off, there is residual water in a gap between each of the plurality of needles 21 and a corresponding one of the plurality of water outlet holes 111. It is easy to generate bacteria between each of the plurality of needles 21 and a corresponding one of the plurality of water outlet holes 111 if the residual water is not drained out. Therefore, if the plurality of needles 21 can be moved into the plurality of water outlet holes 111 to remove deposits during water flows, and the plurality of needles 21 can be removed from the plurality of water outlet holes 111 after the water is shut off, so that the residual water in the plurality of water outlet holes 111 can be completely drained out, the technical solution is more reasonable.

In order to achieve the aforementioned effects, in this embodiment, the body 1 further comprises a movable member 4. The movable member 4 is driven by the flowing water and moves in an axial direction of the body 1. The deposit removal needle plate 2 and the movable member 4 are connected in the axial direction of the body 1. When water flows into the shower head, the water flows to drive the movable member 4 to drive the deposit removal needle plate 2 to move downward in the axial direction of the body 1, so that each of the plurality of needles 21 moves into a corresponding one of the plurality of water outlet holes 111 of the water outlet cover 11. This causes each of the plurality of needles 21 to enter a corresponding one of the plurality of water outlet holes 111, enabling the removal of the deposits when the water flows.

Further, in order to cause each of the plurality of needles 21 to be removed from a corresponding one of the plurality of water outlet holes 111 when the water is shut off, a reset member 5 is disposed between the deposit removal needle plate 2 and the water outlet cover 11. When the deposit removal needle plate 2 moves downward in the axial direction of the body 1, the reset member 5 accumulates an elastic reset force. Therefore, when the water is shut off, the elastic reset force drives the deposit removal needle plate 2 to move upward and reset in the axial direction of the deposit removal needle plate 2.

In order to install the moving member 4, in the axial direction of the chamber 121, a second end of the chamber 121 away from the water inlet 122 is disposed with a through hole 124. A first end of the movable member 4 passes through the through hole 124, abuts the deposit removal needle plate 2 is linked to the deposit removal needle plate 2. A second end of the movable member 4 is located in the chamber 121. When water flows from the water inlet 122 into the chamber 121, the water flows collide against the movable member 4 to drive the movable member 4 to move downward in the axial direction of the chamber 121.

In an axial direction of the cam 31, the cam 31 comprises a locating hole 33. The movable member 4 is inserted into the connecting member 22 through the locating hole 33 and, in the axial direction of the cam 31, abuts a bottom end surface of the connecting member 22.

In this embodiment, in order to further optimize an efficiency of deposit removing, the second end of the movable member 4 disposed in the chamber 121 is a water storage end 41. When no water flows into the chamber 121 from the water inlet 122, the reset member 5 drives the deposit removal needle plate 2 to move upward in the axial direction of the deposit removal needle plate 2, so that the water storage end 41 moves upward to the water inlet 122 in the axial direction of the moving member 4.

The purpose of the aforementioned assembly is that the water storage end 41 has a certain water storage function when the water flows. Only when the water pressure reaches a certain value does the moving member 4 move downward in the axial direction of the moving member 4 to completely open the water inlet 122. This allows the water flow rate entering into the chamber 121 to be relatively fast, and an initial rotation speed of the impeller to be relatively fast. Therefore, a swinging speed of the needle 21 is also increased, and a friction between the plurality of needles 21 and the inner wall of the plurality of water outlet holes 111 is increased, so that a strength of deposit removing is increased.

Embodiment 2

A self-cleaning water outlet device of Embodiment 2 differs from Embodiment 1 in that the deposit removal needle plate 2 is a flowing water switchable member, and the flowing water switchable member comprises a plurality of switchable units. A direction of the flowing water in the plurality of water outlet holes 111 is changed in accordance with a swing movement of the plurality of switchable units during a swinging process. The self-cleaning water outlet device can form a large particle water spray pattern in which the water droplets are cone-shaped, a distribution of the water spray pattern is more uniform, a coverage is large, a pulse effect is achieved, and a shower experience is excellent.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

INDUSTRIAL APPLICABILITY

The self-cleaning water outlet device provided by the present disclosure drives the descaling needle plate to swing by the rotation of the impeller, thereby causing the needle to swing about the axial direction in the water outlet hole of the water outlet cover. The needle abuts the inner wall of the water outlet hole during the swinging process, so that the scale attached to the inner wall of the water outlet hole falls off as the needle swings. During the water discharge process, the needles swing about an axial direction in water outlet holes of a water outlet cover, so that the scale or sediment attached to the inner walls of the water outlet holes is automatically removed. An application range of the present disclosure is broad, and the present disclosure has a good industrial applicability.

What is claimed is:

1. A self-cleaning water outlet device, comprising:
a body,
a deposit removal needle plate disposed in the body,
a water outlet cover comprising a plurality of water outlet holes, and
a rotatable member driven to rotate about an axial direction of the rotatable member by flowing water, wherein:
an axial direction of the deposit removal needle plate and an axial direction of the water outlet cover are coaxial,
the deposit removal needle plate comprises a plurality of needles and at least one flow hole, wherein the at least one flow hole is offset from the plurality of needles,
the deposit removal needle plate is swingably connected to the rotatable member,
each of the plurality of needles defines a solid structure, and
when water flows into the self-cleaning water outlet device:
the water drives the rotatable member to rotate continuously,
the water flows through the at least one flow hole and a clearance between the plurality of needles and inner walls of the plurality of water outlet holes,
a lower side of the deposit removal needle plate are filled with the water flowing from the at least one flow hole,
the rotatable member drives the plurality of needles to swing continuously about the axial direction of the deposit removal needle plate in the plurality of water outlet holes, and
the plurality of needles rub against sediment deposited on the inner walls of the plurality of water outlet holes while the plurality of needles are swinging to dislodge the sediment.

2. The self-cleaning water outlet device according to claim 1, wherein:
the body comprises an oblique water body,
the oblique water body comprises a chamber,
in an axial direction of the chamber, a first end of the chamber is disposed with a water inlet, and
a sidewall of the chamber is disposed with a plurality of oblique water outlets arranged along a circumferential direction of the chamber.

3. The self-cleaning water outlet device according to claim 2, wherein:
the rotatable member is an impeller disposed outside of the sidewall of the chamber,
the water flows into the impeller from the plurality of oblique water outlets, and
blades of the impeller are impacted to drive the impeller to rotate by the water.

4. The self-cleaning water outlet device according to claim 3, wherein:
a first side of the impeller facing the deposit removal needle plate extends downward in the axial direction of the rotatable member to form a cam,
a first side of the deposit removal needle plate facing the oblique water body extends upward in the axial direction of the deposit removal needle plate to form a connecting member,
the cam is disposed in the connecting member, and
a sidewall of the cam abuts a sidewall of the connecting member to define a swing connection.

5. The self-cleaning water outlet device according to claim 4, wherein:
the impeller is disposed with a water outlet at, in the axial direction of the rotatable member, a lower end of the impeller,
the water flows out from the plurality of oblique water outlets, enters into the impeller, flows out from the water outlet, and then flows to the deposit removal needle plate,
the at least one flow hole is disposed in the axial direction of the deposit removal needle plate, and
the water flows from the at least one flow hole into the plurality of water outlet holes.

6. The self-cleaning water outlet device according to claim 5, further comprising:
a movable member, wherein:
the movable member is driven by the water and moves in an axial direction of the body,
the deposit removal needle plate and the movable member are connected in the axial direction of the body, and
when the water flows into the self-cleaning water outlet device:
the water flows to drive the movable member to drive the deposit removal needle plate to move downward in the axial direction of the body, and
the plurality of needles move into the plurality of water outlet holes.

7. The self-cleaning water outlet device according to claim 6, wherein:
in the axial direction of the chamber, a second end of the chamber away from the water inlet is disposed with a through hole,
a first end of the movable member passes through the through hole and abuts the deposit removal needle plate and is linked to the deposit removal needle plate,
a second end of the movable member is disposed in the chamber, and
when the water flows from the water inlet into the chamber:
an impact force generated by the water flowing on the movable member drives the movable member to move downward in the axial direction of the chamber.

8. The self-cleaning water outlet device according to claim 7, wherein:
in an axial direction of the cam, the cam is disposed with a locating hole, and
the movable member is inserted into the connecting member through the locating hole and abuts, in the axial direction of the cam, a bottom end surface of the connecting member.

9. The self-cleaning water outlet device according to claim 8, wherein:
a reset member is disposed between the deposit removal needle plate and the water outlet cover, and
when the deposit removal needle plate moves downward in the axial direction of the deposit removal needle plate, the reset member accumulates an elastic reset force.

10. The self-cleaning water outlet device according to claim 9, wherein:
the second end of the movable member is a water storage end, and
when no water flows into the chamber from the water inlet:

the reset member drives the deposit removal needle plate to move upward in the axial direction of the deposit removal needle plate, and the water storage end moves upward, in an axial direction of the movable member, toward the water inlet.

11. A swinging water outlet device, comprising:

a body, a flowing water switchable member disposed in the body, a water outlet cover comprising a plurality of water outlet holes, and a rotatable member driven to rotate about an axial direction of the rotatable member by flowing water, wherein:

an axial direction of the flowing water switchable member and an axial direction of the water outlet cover are coaxial, the flowing water switchable member comprises a plurality of switchable units and at least one flow hole, wherein the at least one flow hole is offset from the plurality of switchable units, the flowing water switchable member is swingably connected to the rotatable member, each of the plurality of switchable units defines a solid structure, and when water flows into the swinging water outlet device:

the water drives the rotatable member to rotate continuously, the water flows through the at least one flow hole and a clearance between the plurality of switchable units and inner walls of the plurality of water outlet holes, a lower side of the flowing water switchable member are filled with the water flowing from the at least one flow hole, the rotatable member drives the plurality of switchable units to swing continuously about the axial direction of the flowing water switchable member in the plurality of water outlet holes, and a flow direction of the water in the plurality of water outlet holes changes due to a swing movement of the plurality of switchable units.

12. The swinging water outlet device according to claim 11, wherein:

the body comprises an oblique water body, the oblique water body comprises a chamber, in an axial direction of the chamber, a first end of the chamber is disposed with a water inlet, and a sidewall of the chamber is disposed with a plurality of oblique water outlets arranged along a circumferential direction of the chamber.

13. The swinging water outlet device according to claim 12, wherein:

the rotatable member is an impeller disposed outside of the sidewall of the chamber, the water flows into the impeller from the plurality of oblique water outlets, and blades of the impeller are impacted to drive the impeller to rotate by the water.

14. The swinging water outlet device according to claim 13, wherein:

a first side of the impeller facing the flowing water switchable member extends downward in the axial direction of the rotatable member to form a cam, a first side of the flowing water switchable member facing the oblique water body extends upward in the axial direction of the flowing water switchable member to form a connecting member, the cam is disposed in the connecting member, and a sidewall of the cam abuts a sidewall of the connecting member to define a swing connection.

15. The swinging water outlet device according to claim 14, wherein:

the impeller is disposed with a water outlet at, in the axial direction of the rotatable member, a lower end of the impeller, the water flows out from the plurality of oblique water outlets, enters into the impeller, flows out from the water outlet, and flows to the flowing water switchable member, the at least one flow hole is disposed in the axial direction of the flowing water switchable member, and the water flows from the at least one flow hole into the plurality of water outlet holes.

16. The swinging water outlet device according to claim 15, further comprising:

a movable member, wherein:

the movable member is driven by the water and moves in an axial direction of the body, the flowing water switchable member and the movable member are connected in the axial direction of the body, and when the water flows into the swinging water outlet device:

the water flows to drive the movable member to drive the flowing water switchable member to move downward in the axial direction of the body, and the plurality of switchable units move into the plurality of water outlet holes.

17. The swinging water outlet device according to claim 16, wherein:

in the axial direction of the chamber, a second end of the chamber away from the water inlet is disposed with a through hole, a first end of the movable member passes through the through hole and abuts the flowing water switchable member and is linked to the flowing water switchable member, a second end of the movable member is disposed in the chamber, and when the water flows from the water inlet into the chamber:

an impact force generated by the water flowing on the movable member drives the movable member to move downward in the axial direction of the chamber.

18. The swinging water outlet device according to claim 17, wherein:

in an axial direction of the cam, the cam is disposed with a locating hole, and the movable member is inserted into the connecting member through the locating hole and abuts, in the axial direction of the cam, a bottom end surface of the connecting member.

19. The swinging water outlet device according to claim 18, wherein:

a reset member is disposed between the flowing water switchable member and the water outlet cover, and when the flowing water switchable member moves downward in the axial direction of the flowing water switchable member, the reset member accumulates an elastic reset force.

20. The swinging water outlet device according to claim 19, wherein:

the second end of the movable member is a water storage end, and when no water flows into the chamber from the water inlet:

the reset member drives the flowing water switchable member to move upward in the axial direction of the flowing water switchable member, and the water storage end moves upward, in an axial direction of the movable member, toward the water inlet.

21. The self-cleaning water outlet device according to claim 1, wherein:

when the water flows into the self-cleaning water outlet device:

the water flows to drive the deposit removal needle plate to move downward in an axial direction of the body, and the plurality of needles move into the plurality of water outlet holes.

22. A self-cleaning water outlet device, comprising:

a body, a deposit removal needle plate disposed in the body, a water outlet cover comprising a plurality of water outlet holes, and a rotatable member driven to rotate about an axial direction of the rotatable member by flowing water, wherein:

an axial direction of the deposit removal needle plate and an axial direction of the water outlet cover are coaxial, the deposit removal needle plate comprises a plurality of needles, the deposit removal needle plate is swingably connected to the rotatable member, when water flows into the self-cleaning water outlet device:

the water flows to drive the deposit removal needle plate to move downward in an axial direction of the body, the plurality of needles move into the plurality of water outlet holes, the water drives the rotatable member to rotate continuously, the rotatable member drives the plurality of needles to swing continuously about the axial direction of the deposit removal needle plate in the plurality of water outlet holes, and the plurality of needles rub against sediment deposited on inner walls of the plurality of water outlet holes while the plurality of needles are swinging to dislodge the sediment, and when the water is shut off:

the deposit removal needle plate moves upward to move the plurality of needles away from the plurality of water outlet holes.

* * * * *